US008682009B2

(12) United States Patent
Baffoun et al.

(10) Patent No.: US 8,682,009 B2
(45) Date of Patent: Mar. 25, 2014

(54) MAGNETOSTRICTIVE MICROLOUDSPEAKER

(75) Inventors: Bassem Baffoun, Gerlingen (DE); Reinhard Lerch, Heroldsberg (DE); Alexander Sutor, Erlangen (DE); Christian Weistenhöfer, Bubenreuth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 994 days.

(21) Appl. No.: 12/667,564

(22) PCT Filed: Jul. 1, 2008

(86) PCT No.: PCT/EP2008/058436

§ 371 (c)(1),
(2), (4) Date: May 5, 2010

(87) PCT Pub. No.: WO2009/004000

PCT Pub. Date: Jan. 8, 2009

(65) Prior Publication Data

US 2011/0116663 A1 May 19, 2011

Related U.S. Application Data

(60) Provisional application No. 60/958,090, filed on Jul. 2, 2007.

(30) Foreign Application Priority Data

Jul. 2, 2007 (DE) ..... 10 2007 030 744

(51) Int. Cl.
*H04R 25/00* (2006.01)

(52) U.S. Cl.
USPC ..... 381/190; 381/191

(58) Field of Classification Search
USPC ..... 381/322, 173, 174, 175, 177, 190, 191; 310/26, 334; 438/50
See application file for complete search history.

(56) References Cited

U.S. PATENT DOCUMENTS 3,288,942 A * 11/1966 Voegeli ..... 381/177
4,985,985 A 1/1991 Das (Continued)

FOREIGN PATENT DOCUMENTS

DE 4220226 A1 12/1993
DE 3884371 T2 3/1994

(Continued)

OTHER PUBLICATIONS

Neumann JR, et al: "CMOS-MEMS membrane for Audio-Frequency Acoustic Actuation", MEMS laboratory, Electrical and Computer Engineering Department.Carnegie Mellon University, 2002, pp. 175-182, Pittsburgh, USA.

(Continued)

*Primary Examiner* — Huyen D Le
(74) *Attorney, Agent, or Firm* — Laurence A. Greenberg; Werner H. Stemer; Ralph E. Locher

(57) ABSTRACT

An acoustic actuator includes a support layer, in which a self-supporting structure is defined and connected to the support layer by at least two suspensions, at least one magnetostrictive layer which has been disposed on the support layer and is provided at least in part on the self-supporting structure, and a device for generating a magnetic field in the magnetostrictive layer. The way in which the loudspeaker works is based on the magnetostrictive effect, which results in a change in the dimensions of the self-supporting structure in an alternating magnetic field. This causes the self-supporting structure to oscillate. A method for producing an acoustic actuator is also provided.

22 Claims, 1 Drawing Sheet

(56) References Cited

U.S. PATENT DOCUMENTS

| | | | | |
|---|---|---|---|---|
| 5,588,466 | A | 12/1996 | Benz et al. | |
| 6,362,543 | B1 * | 3/2002 | Ellis | 310/26 |
| 2010/0296681 | A1 * | 11/2010 | Albach et al. | 381/322 |

FOREIGN PATENT DOCUMENTS

| | | | |
|---|---|---|---|
| DE | 19510250 | C1 | 5/1996 |
| DE | 102004063497 | A1 | 8/2005 |
| EP | 0111227 | A2 | 6/1984 |

OTHER PUBLICATIONS

Baffoun et al: "Development in Combined Si-Based Magnetic Microactuator", Sensors, 2005 IEEE, Oct. 31, 2005, XP010899690, pp. 461-463, Piscataway, New Jersey, USA.

Baffoun et al: "Bimorph Magnetostrictive Microactuator Based on Silicon Bulkmicromachining", Actuators 2004: 9th International Conference on New Actuators and 3rd International Exhibition on Smart Actuators and Drive Systems; Jun. 14-16, 2004, pp. 577-580, Bremen, Germany.

* cited by examiner

MAGNETOSTRICTIVE MICROLOUDSPEAKER

BACKGROUND OF THE INVENTION

Field of the Invention

The invention relates to an acoustic actuator (loudspeaker) which is suitable for hearing aids, for example, and to a method for the production thereof.

Conventional and known acoustic actuators are based on the electromagnetic principle. It is known practice to produce loudspeakers using micromechanical production methods, for example from Neumann et al., "CMOS-MEMS Membrane for Audio-Frequency Acoustic Actuation", Sensors and actuators, A95,2002, pp. 175-182. Magnetic, electrostatic and piezoelectric actuators are known in this case.

BRIEF SUMMARY OF THE INVENTION

It is the object of the present invention to provide an acoustic actuator (e.g. a loudspeaker for the audible range) and the associated production method. In this case, the dimensions of the actuator need to be small, the sound level generated by the actuator in the audible range needs to be high and the power consumption needs to be very efficient in order to keep the supply voltage as low as possible.

The invention achieves this aim by means of an acoustic actuator in accordance with the invention and the production method in accordance with the invention.

The acoustic actuator according to the invention has the following features:

- a support layer, in which
- a self-supporting structure is defined
- which is connected to the support layer by means of one or more suspensions, preferably by means of at least two suspensions,
- at least one magnetostrictive layer, which has been put on the support layer and is provided at least in part on the self-supporting structure, and
- means for generating a magnetic field in the magnetostrictive layer.

Preferably, the means for generating a magnetic field can be put on the support layer. Suspension by means of at least two suspensions advantageously affords increased mechanical rigidity.

The way in which the loudspeaker works is based on the magnetostrictive effect, which results in a change in the dimensions or in the geometry of the self-supporting structure in an alternating magnetic field, the magnetostrictive layer being provided on at least one portion of the area of the self-supporting structure. This causes the self-supporting structure to oscillate.

The support layer may comprise silicon dioxide. By way of example, this silicon dioxide layer can be produced by oxidizing a silicon substrate. The self-supporting structure acts as an oscillatable diaphragm for the actuator.

The magnetostrictive layer is constructed using a magnetostrictive material. This is a material whose dimensions change under the influence of a variable magnetic field. The material needs to have the highest possible level of permeability. The magnetostrictive layer may preferably contain FeCo. In this case, the magnetostrictive layer preferably exhibits magnetic anisotropy. This is achieved by applying an external magnetic field to the magnetostrictive layer while or after the magnetostrictive layer is deposited or put onto the support layer. The magnetic anisotropy allows the magnetostrictive effect to be increased. By way of example, the magnetic anisotropy can define a light magnetic axis in the plane of the magnetostrictive layer. It would also be possible to have an arrangement comprising a plurality of magnetostrictive layers which are isolated from one another by metal or non-conductive layers.

Depending on the internal mechanical stresses in the support layer and in the magnetostrictive layer, the ratio of thicknesses between the two layers needs to be defined such that the static curvature of the self-supporting structure is minimized.

Preferably, the ratio of thicknesses for the magnetostrictive layer to the support layer is 1 to 3 or less, preferably 1 to 10 or less.

In line with one preferred aspect of the invention, the means for generating a magnetic field is in the form of a solenoid coil (cylindrical coil), with the magnetostrictive layer forming the coil core.

In line with an alternative preferred aspect of the present invention, the means for generating the magnetic field is in the form of a torroidal meandering coil (meandering annular coil).

In line with one preferred aspect of the present invention, the coil winding and the coil core have an electrically insulating layer provided between them.

In line with one preferred aspect of the present invention, the magnetostrictive layer at least partially covers the suspension or suspensions of the self-supporting structure.

Preferably, the support layer is between 0.2 and 10 μm, more preferably between 0.5 and 2 μm and most preferably 1 μm thick. A layer of the magnetostrictive material is preferably between 0.1 and 1 μm, more preferably between 0.2 and 0.5 μm and most preferably between 250 and 350 nm thick. In line with one preferred embodiment, the layer of magnetostrictive material is 300 nm thick.

The invention also relates to a method for producing an acoustic actuator, involving:

a) a support layer being produced;

b) support layer material being removed in order to define, in the area of the support layer, a self-supporting structure which is connected to the rest of the support layer by means of one or more suspensions, preferably by means of at least two suspensions;

c) a magnetostrictive layer (4) being put on which is put at least partially on the support layer and is provided at least partially on the self-supporting structure; and d) means for generating a magnetic field in the magnetostrictive layer being provided. The inventive method for producing the actuator may involve the use of micromechanical methods or else chemical processing steps.

In line with one preferred aspect of the present invention, the support layer comprises silicon dioxide and is produced by oxidizing the surface of a silicon substrate. As the starting material, a layer of a silicon substrate or a silicon substrate essentially in the form of a flat feature may be oxidized, from both sides, so that an oxide layer is produced on both surfaces. In the later process, one of these two oxide layers will define the self-supporting structure, which then acts as an oscillating diaphragm for the actuator. The oxide layer forms the support layer. The self-supporting structure can be produced by chemical etching or by micromechanical processing in the support layer.

The support layer has a magnetostrictive layer put onto it. Additional layers may be provided between the support layer and the magnetostrictive layer. To put on the magnetostrictive layer, it is possible to use chemical deposition methods, physical deposition methods or vacuum methods, e.g. chemical vapor deposition (CVD) or physical vapor deposition, sputtering or other suitable methods. To produce the self-supporting structure in the support layer, the support layer material can be removed before or after the magnetostrictive layer is put on.

In line with one preferred aspect of the present invention, the means for generating a magnetic field are provided in the form of a solenoid coil. This can be produced in the following manner:

e) a plurality of first interconnects are put on the support layer;

f) the magnetostrictive layer is put at least partially on the support layer and at least partially put over the first interconnects in order to define a coil core; and g) a plurality of second interconnects are put on in order to define, together with the first interconnects, coil windings for the solenoid coil. In this case, the first interconnects are situated "on" the support layer and the region of the magnetostrictive layer which forms the coil core is situated partially "over" the interconnects, and the coil core has an appropriate plurality of second interconnects put on it which are connected to the first interconnects in a manner such that the first and second interconnects form coil windings around the coil core.

In line with one preferred aspect of the present invention, the first and second interconnects and the magnetostrictive layer (i.e. the region of the magnetostrictive layer which forms the coil core) can have a layer of an electrically insulating material put on between them.

In line with one preferred aspect of the present invention, a magnetic field is applied to the actuator while the magnetostrictive layer is being put on or after the magnetostrictive layer is put on, in order to produce magnetic anisotropy in the magnetostrictive layer.

BRIEF DESCRIPTION OF THE SEVERAL VIEWS OF THE DRAWING

The actuator according to the invention and the production method according to the invention will be described by way of example below with reference to the appended drawings, in which.

DESCRIPTION OF THE INVENTION

Figure 1:
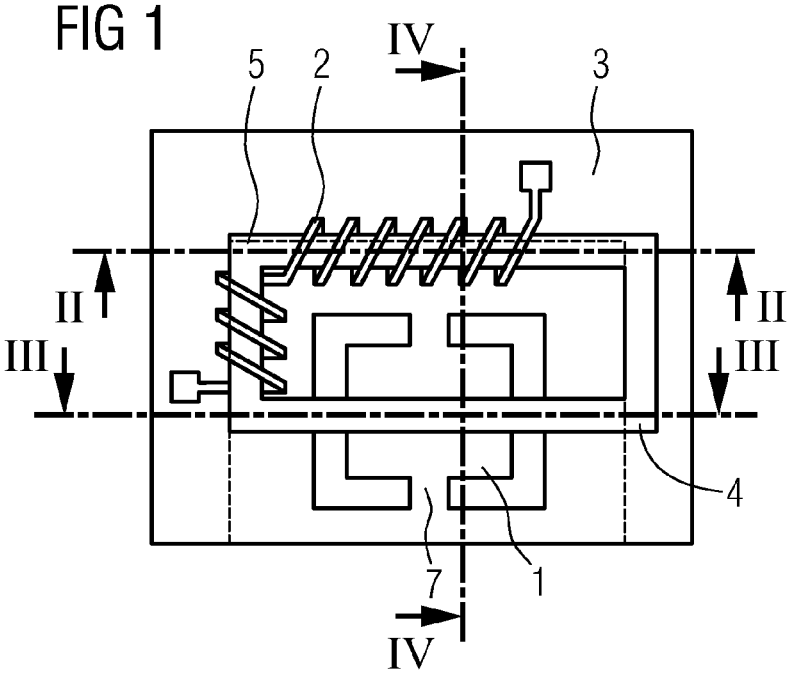
FIG. 1 shows an embodiment of an actuator according to the invention.

FIG. 1 shows an embodiment of an actuator according to the invention. A self-supporting structure 1 which acts as an oscillating diaphragm is defined in the support layer 3 and is connected thereto by means of suspensions 7. The support layer 3 has had a magnetostrictive layer 4 put on it. It is formed from a magnetostrictive material, i.e. a material whose dimensions are altered under the action of a magnetic field. Preference is given to a material with a high level of permeability, e.g. FeCo. The magnetostrictive layer 4 has been put partially on or over the self-supporting structure 1. Interconnects 2 define a coil which is wound around a region 5 of the magnetostrictive layer 4, the region 5 acting as a coil core 5. When current flows in the coil 2, a magnetic field can be generated in the magnetostrictive layer 4, which field can cause the self-supporting structure 1 to oscillate and hence sound to be emitted. It is advantageous that in such an arrangement the actuator and its drive mechanism, that is to say the coil, are situated on the same chip. This allows the arrangement to be miniaturized. The expansion of a closed magnetic circuit, the proximity of the coil turns to the coil core and the high level of permeability of the magnetostrictive layer mean that only a low supply voltage or current level is required. Since the same layer as causes the actuator to oscillate is also used for routing magnetic flux, an optimum energy yield is possible. Preferably, the magnetostrictive layer is magnetically anisotropic.

Figure 2:
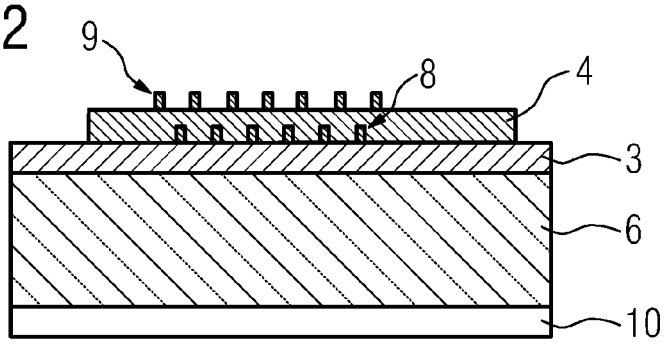
FIG. 2 shows a sectional view along the line I in the embodiment from FIG. 1.
Figure 4:
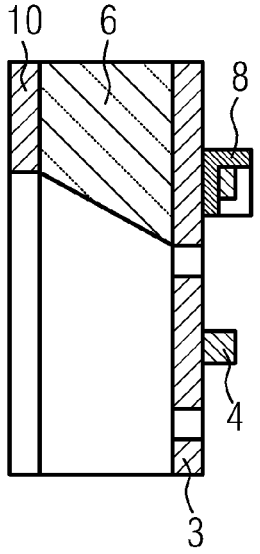
FIG. 4 shows a sectional view of the embodiment from FIG. 1 along the line III.
Figure 3:
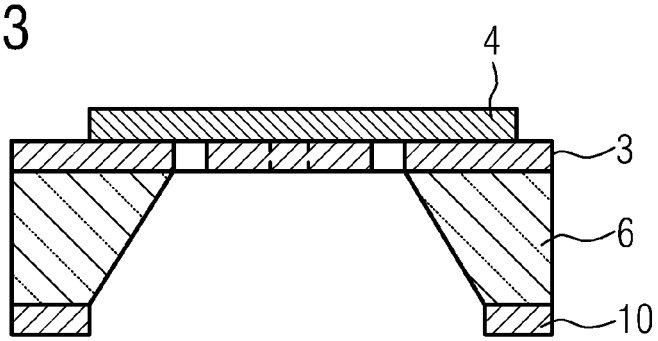
FIG. 3 shows a sectional view of the embodiment from FIG. 1 along the line II.

The layered design of the actuator according to the invention can be illustrated with reference to FIGS. 2-4. The starting material used, as FIG. 2 shows, is a silicon substrate 6 which is oxidized from both sides 3, 10 in order to obtain a support layer 3 comprising silicon oxide.

An anisotropic etching process (e.g. using KOH) allows the self-supporting diaphragm 1 to be produced by dissolving away the silicon 6 in previously determined openings in the silicon dioxide 3 and 10. This method can also take place in other suitable chemical baths, and it would be equally possible to use another micromechanical method (e.g. surface micromechanics or laser technology). This process step should take place after all the layers have been deposited and patterned so that no additional mechanical stresses are induced in diaphragm 1. The magnetostrictive layer 4 can be put onto the support layer 3 before the self-supporting structure is carved out. The magnetostrictive layer 4 can be patterned by chemical means (e.g. using HNO3) or by physical means. The patterned magnetostrictive layer 4 is intended to cover the diaphragm 1 in part or completely. The shape and design of the structure can be varied as desired in order to optimize the behavior of the actuator. It is advantageous if the magnetostrictive layer in part covers the suspensions 7 of the diaphragm 1. The diaphragm 1 can be patterned from the oxide 3 by chemical means (e.g. HF) from both sides of the substrate without damaging the layer 4 in the process. During further processing operations, the edges of the diaphragm 1 can be temporarily protected by a thin Cr layer which can be removed at the end of the process.

To integrate the control coil 2 on the support layer 3, a plurality of first interconnects 8 comprising a metal material, e.g. Cu or Al, can be put on the silicon dioxide in a high-vacuum process, e.g. by vapor deposition, before the magnetostrictive layer 4 is deposited. Following patterning using a chemical or physical etching process, these first interconnects 8 form the bottom lines of the coil 2. These are situated outside of the region of the self-supporting structure 1. When Al or Cu is selected as the conductive layer and FeCo is selected as the core 5 of the coil 2, an insulating layer between the core and the turns is not necessary, since the specific resistance of FeCo is very high in comparison with that of Al and Cu. This also applies to other magnetostrictive materials which have a similar behavior. Otherwise, insulating layers such as silicon dioxide or alumina are required between the coil winding and the coil core. Next, the magnetostrictive layer 4 is put on the support layer 3 over the first interconnect 8 (see FIG. 2). A second plurality of interconnects 9 is then put onto the magnetostrictive layer 4 using the same method as for the first interconnects 8. In this case, it is necessary to ensure that the bottom and top interconnects 8 and 9 are connected to one another, and these then define the windings of the coil 2 (cf. FIG. 4). Next, an anisotropic etching operation for the silicon 6 can be used to define the self-supporting structure 1 in the substrate and in the support layer 3. During this etching operation, the exposed regions of the coil winding 2 can be protected with Cr. In this design, a solenoid coil (cylindrical coil) has been produced, but it would also be possible to produce a flat spiral coil or a torroidal meandering coil (meandering annular coil).

As regards the physical arrangement and dimensions of the actuator, many variations are possible which can be optimized for the area in which the actuator is being used. The actuator can be used not only as a loudspeaker but also conversely as a microphone. Advantageously, this arrangement has a closed magnetic circuit and hence reduced stray fields. For electromagnetic transducers, the magnetic circuit must always be open. Another advantage of the actuator according to the invention is its silicon-based monolithic structure, which allows later integration of evaluation electronics on the chip. The production steps are simple and inexpensive and can be implemented using customary chemical or micromechanical methods which are known to a person skilled in the art.

The invention claimed is:

1. An acoustic actuator, comprising:

a support layer defining a self-supporting structure therein;

at least one suspension connecting said self-supporting structure to said support layer;

at least one magnetostrictive layer disposed on said support layer and at least partly on said self-supporting structure; and a device for generating a magnetic field in said magnetostrictive layer, said device for generating a magnetic field including a solenoid coil and a coil core formed by said at least one magnetostrictive layer.

2. The actuator according to claim 1, wherein said at least one suspension is at least two suspensions.

3. The actuator according to claim 2, wherein said at least one magnetostrictive layer at least partially covers said at least two suspensions of said self-supporting structure.

4. The actuator according to claim 1, wherein said support layer is formed of silicon dioxide.

5. The actuator according to claim 1, wherein said at least one magnetostrictive layer contains FeCo.

6. The actuator according to claim 1, wherein said at least one magnetostrictive layer exhibits magnetic anisotropy.

7. The actuator according to claim 1, wherein said at least one magnetostrictive layer is a plurality of magnetostrictive layers.

8. The actuator according to claim 1, wherein said at least one magnetostrictive layer and said support layer have a ratio of thicknesses of 1:10 or less.

9. The actuator according to claim 1, which further comprises an electrically insulating layer disposed between said coil and said coil core.

10. The actuator according to claim 1, wherein said support layer is between 0.5 and 2 μm thick.

11. An acoustic actuator, comprising:

a support layer defining a self-supporting structure therein;

at least one suspension connecting said self-supporting structure to said support layer;

at least one magnetostrictive layer disposed on said support layer and at least partly on said self-supporting structure; and a device for generating a magnetic field in said magnetostrictive layer, said device for generating a magnetic field including a toroidal meandering coil and a coil core formed by said at least one magnetostrictive layer.

12. The actuator according to claim 11, which further comprises an electrically insulating layer disposed between said coil and said coil core.

13. A method for producing an acoustic actuator, the method comprising the following steps:

a) producing a support layer;

b) removing material of the support layer to define, in vicinity of the support layer, a self-supporting structure connected to the support layer by at least two suspensions;

c) placing a magnetostrictive layer at least partially on the support layer and at least partially on the self-supporting structure; and d) generating a magnetic field in the magnetostrictive layer using a solenoid coil and a coil core formed by the magnetostrictive layer.

14. The method according to claim 13, which further comprises producing the support layer of silicon dioxide by oxidizing a surface of a silicon substrate.

15. The method according to claim 13, which further comprises producing the self-supporting structure by chemical etching in the support layer.

16. The method according to claim 13, which further comprises producing the self-supporting structure by micromechanical processing in the support layer.

17. The method according to claim 13, which further comprises carrying out the step of removing material of the support layer only after the magnetostrictive layer has been put in place.

18. The method according to claim 13, which further comprises depositing the magnetostrictive layer on the support layer by a vacuum method.

19. The method according to claim 13, which further comprises providing the solenoid coil by:

e) placing a plurality of first interconnects on the support layer;

f) placing the magnetostrictive layer at least partially on the support layer and at least partially over the first interconnects to define the coil core; and g) placing a plurality of second interconnects on the magnetostrictive layer to define coil windings for the solenoid coil with the first and second interconnects.

20. The method according to claim 19, which further comprises placing an electrically insulating material between the first and second interconnects and the magnetostrictive layer.

21. The method according to claim 13, which further comprises exposing the magnetostrictive layer to a magnetic field during or after the step of placing the magnetostrictive layer, to produce magnetic anisotropy in the magnetostrictive layer.

22. A method for producing an acoustic actuator, the method comprising the following steps:

a) producing a support layer;

b) removing material of the support layer to define, in vicinity of the support layer, a self-supporting structure connected to the support layer by at least two suspensions;

c) placing a magnetostrictive layer at least partially on the support layer and at least partially on the self-supporting structure; and d) generating a magnetic field in the magnetostrictive layer using a toroidal meandering coil and a coil core formed by the magnetostrictive layer.

* * * * *